US011361722B2

(12) United States Patent
Guo et al.

(10) Patent No.: US 11,361,722 B2
(45) Date of Patent: Jun. 14, 2022

(54) DRIVING METHOD, CONSTRUCTION METHOD FOR COMPENSATION TABLE AND DISPLAY DECIVE

(71) Applicant: HKC CORPORATION LIMITED, Shenzhen (CN)

(72) Inventors: Dongsheng Guo, Shenzhen (CN); Haijiang Yuan, Shenzhen (CN); Yubo Gu, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/325,241

(22) Filed: May 20, 2021

(65) Prior Publication Data

US 2022/0036841 A1 Feb. 3, 2022

(30) Foreign Application Priority Data

Jul. 30, 2020 (CN) ..... 202010750940.8

(51) Int. Cl.

*G09G 3/36* (2006.01)
*G09G 3/20* (2006.01)
*G09G 3/00* (2006.01)

(52) U.S. Cl.

CPC ..... *G09G 3/3614* (2013.01); *G09G 3/006* (2013.01); *G09G 3/2007* (2013.01); *G09G 3/3648* (2013.01); *G09G 3/3674* (2013.01); *G09G 3/3685* (2013.01); *G09G 3/3696* (2013.01); *G09G 2310/08* (2013.01); *G09G 2320/0209* (2013.01); *G09G 2320/0233* (2013.01); *G09G 2320/0693* (2013.01); *G09G 2330/12* (2013.01)

(58) Field of Classification Search

CPC .... G09G 3/3614; G09G 3/006; G09G 3/2007; G09G 3/3648; G09G 3/3674; G09G 3/3685; G09G 3/3696; G09G 2310/08; G09G 2320/0209; G09G 2320/0233; G09G 2320/0693; G09G 2330/12

See application file for complete search history.

(56) References Cited

U.S. PATENT DOCUMENTS 5,745,087 A * 4/1998 Tomiyoshi ..... G09G 3/3648 345/89
6,417,829 B1 * 7/2002 Jung ..... G09G 3/3677 345/98
7,633,475 B2 * 12/2009 Park ..... G09G 3/3611 345/89
7,777,765 B2 * 8/2010 Adachi ..... G09G 3/2025 345/690
8,212,799 B2 * 7/2012 Kerwin ..... G09G 3/3611 345/208

(Continued)

*Primary Examiner* — Michael J Jansen, II

(57) ABSTRACT

The present application discloses a driving method, a construction method for a compensation table and a display device. The driving method includes steps of: generating a plurality of first gate drive signals and a plurality of second gate drive signals, driving scanning lines to turn on sequentially or non-sequentially in a group of two, and generating corresponding data driving signals to drive corresponding pixels, where the first gate drive signals are output to the first turned-on scanning lines in each group, the second gate drive signals are output to the last turned-on scanning lines in each group, and the high-level duration of the first gate drive signals is T+Δt.

16 Claims, 8 Drawing Sheets

(56) References Cited

U.S. PATENT DOCUMENTS

| | | | | |
|---|---|---|---|---|
| 8,766,894 | B2 * | 7/2014 | Park | G09G 5/005 345/89 |
| 9,330,586 | B2 * | 5/2016 | Pyun | G09G 3/3607 |
| 11,183,131 | B2 * | 11/2021 | Li | G09G 3/3688 |
| 2005/0200619 | A1 * | 9/2005 | Adachi | G09G 3/3648 345/204 |
| 2006/0061828 | A1 * | 3/2006 | Park | G09G 3/3611 358/300 |
| 2008/0068318 | A1 * | 3/2008 | Kerwin | G09G 3/3611 345/89 |
| 2009/0295840 | A1 * | 12/2009 | Park | G09G 3/3611 345/690 |
| 2013/0155129 | A1 * | 6/2013 | Park | G09G 5/005 345/699 |
| 2013/0201174 | A1 * | 8/2013 | Pyun | G09G 3/3677 345/213 |
| 2014/0218347 | A1 * | 8/2014 | Lee | G02F 1/136286 345/211 |
| 2021/0043154 | A1 * | 2/2021 | Li | G09G 3/3607 |

* cited by examiner

| G1 \ G2 | -255 | -245 | ... | ... | -20 | -10 | 0 | 10 | ... | ... | ... | 245 | 255 |
|---|---|---|---|---|---|---|---|---|---|---|---|---|---|
| 255 | $T_{255,-255}$ | $T_{255,-245}$ | ... | ... | $T_{255,-20}$ | $T_{255,-10}$ | $T_{255,0}$ | $T_{255,10}$ | ... | ... | ... | $T_{255,245}$ | $T_{255,255}$ |
| 245 | $T_{245,-255}$ | $T_{245,-245}$ | ... | ... | $T_{245,-20}$ | $T_{245,-10}$ | $T_{245,0}$ | $T_{245,10}$ | ... | ... | ... | $T_{245,245}$ | $T_{245,255}$ |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| 10 | $T_{10,-255}$ | $T_{10,-245}$ | ... | ... | $T_{10,-20}$ | $T_{10,-10}$ | $T_{10,0}$ | $T_{10,10}$ | ... | ... | ... | $T_{10,245}$ | $T_{10,255}$ |
| 0 | $T_{0,-255}$ | $T_{0,-245}$ | ... | ... | $T_{0,-20}$ | $T_{0,-10}$ | $T_{0,0}$ | $T_{0,10}$ | ... | ... | ... | $T_{0,245}$ | $T_{0,255}$ |
| -10 | $T_{-10,-255}$ | $T_{-10,-245}$ | ... | ... | $T_{-10,-20}$ | $T_{-10,-10}$ | $T_{-10,0}$ | $T_{-10,10}$ | ... | ... | ... | $T_{-10,245}$ | $T_{-10,255}$ |
| ... | ... | ... | ... | ... | ... | ... | ... | ... | ... | ... | ... | ... | ... |
| ... | ... | ... | ... | ... | ... | ... | ... | ... | ... | ... | ... | ... | ... |
| -245 | $T_{-245,-255}$ | $T_{-245,-245}$ | ... | ... | $T_{-245,-20}$ | $T_{-245,-10}$ | $T_{-245,0}$ | $T_{-245,10}$ | ... | ... | ... | $T_{-245,245}$ | $T_{-245,255}$ |
| -255 | $T_{-255,-255}$ | $T_{-255,-245}$ | ... | ... | $T_{-255,-20}$ | $T_{-255,-10}$ | $T_{-255,0}$ | $T_{-255,10}$ | ... | ... | ... | $T_{-255,245}$ | $T_{-255,255}$ |

G1

G2

FIG. 3

| | | | | | | | | |
|---|---|---|---|---|---|---|---|---|
| Line 1 | + | − | + | − | + | − | + | − |
| Line 2 | − | + | − | + | − | + | − | + |
| Line 3 | + | − | + | − | + | − | + | − |
| Line 4 | − | + | − | + | − | + | − | + |
| Line 5 | + | − | + | − | + | − | + | − |
| Line 6 | − | + | − | + | − | + | − | + |

| | | | | | | | | |
|---|---|---|---|---|---|---|---|---|
| Line 1 | + | − | + | − | + | − | + | − |
| Line 2 | + | − | + | − | + | − | + | − |
| Line 3 | − | + | − | + | − | + | − | + |
| Line 4 | − | + | − | + | − | + | − | + |
| Line 5 | + | − | + | − | + | − | + | − |
| Line 6 | + | − | + | − | + | − | + | − |

DRIVING METHOD, CONSTRUCTION METHOD FOR COMPENSATION TABLE AND DISPLAY DECIVE

The present application claims priority to Chinese Patent Application No. 202010750940.8, filed Jul. 30, 2020, which is hereby incorporated by reference herein as if set forth in its entirety.

TECHNICAL FIELD

The present application relates to the field of display technologies, particularly to a driving method, a construction method for a compensation table and a display device.

BACKGROUND

The statements herein merely provide background information related to the present application and do not necessarily constitute the conventional art.

The driving of the display device is to establish a driving electric field according to the phase, peak value, frequency and the like of different signals by adjusting the applied signals so as to realize the effect of displaying a picture by deflecting liquid crystal. The driving of the display device is related to the voltage. The positive and negative polarity inversion is required to apply the voltage to drive the liquid crystal. The most common polarity inversion method is dot inversion, in which a gate driver circuit sequentially supplies gate drive signals to scanning lines on a display panel from a first row to a last row to sequentially Pint on switch elements on each row, and in order to match with the inversion of pixel electrode signals, the data driving signals are switched from positive polarity to negative polarity or from negative polarity to positive polarity at the instant of turning on, that is, in a frame time, for a dot inversion display panel composed of n rows of pixels, the data driving signals on each column of data lines are switched n times between positive polarity and negative polarity, which causes a problem that the conventional dot inversion driving method has large power consumption although the display is uniform. According to different display pictures, two adjacent rows of scanning lines are driven by a same group, and bright and dark stripes are easy to appear due to large cross-voltage.

How to prevent the panel display, from being prone to stripes when the charging time is insufficient or the charging is not saturated in switching to the next row of opposite polarity to improve display picture quality has become an issue that the industry attaches importance to.

SUMMARY

The purpose of the present application is to provide a driving method, a construction method for a compensation table and a display device.

The present application discloses a driving method for a display panel, including steps of generating a plurality of first gate drive signals and a plurality of second gate drive signals, driving scanning lines to turn on sequentially or non-sequentially in a group of two, and generating corresponding data driving signals to drive corresponding pixels; corresponding to a same data line, polarities of the data driving signals of the pixels corresponding to a same group of scanning lines are the same, and polarities of the data driving signals of the pixels corresponding to two adjacent groups of turned-on scanning lines are opposite;

where the first gate drive signals are output to the first turned-on scanning lines in each group, the second gate drive signals are output to the last turned-on scanning lines in each group, and the high-level duration of the first gate drive signals is T+Δt;

the step of generating a plurality of first gate drive signals includes steps of:

obtaining an average gray-scale value G1 of a row of pixels corresponding to the last turned-on scanning lines in the previous group and an average gray-scale value G2 of a row of pixels corresponding to die first turned-on scanning lines in the current group; and obtaining Δt of corresponding scanning lines according to G1 and G2, and generating the first gate drive signals of the scanning lines according to Δt to drive a display panel, where T is equal to an average time for the data drive signals driving each pixel, and Δt is equal to a tune for compensating the first gate drive signals.

The present application discloses a construction method for a compensation table of a display panel, including steps of:

S1: obtaining a first gray-scale value and a second gray-scale value to be tested currently;

S2: testing the initial time difference Δt corresponding to the current first gray-scale value and second gray-scale value;

S3: filling the current initial time difference Δt into the position of Δt corresponding to the first gray-scale value and the second gray-scale value in the compensation table; and S4: establishing a storage unit according to a plurality of tested first gray-scale values, a plurality of tested second gray-scale values and the corresponding initial time difference Δt.

The present application also discloses a display device, which includes a display panel, a gate driver circuit, a source driver circuit and a storage unit, where the gate driver circuit outputs a gate drive signal to drive the display panel, the source driver circuit outputs a data driving signal to drive the display panel, the storage unit stores a preset compensation table and information of Δt corresponding to G1 and G2; where in a same frame of picture, die gate driver circuit outputs the gate drive signals corresponding to each scanning line one to one, and drives the scanning lines to turn on sequentially or non-sequentially in a group of two; corresponding to a same data line, polarities of the data driving signals of the pixels corresponding to a same group of scanning lines are the same, and polarities of the data driving signals of the pixels corresponding to two adjacent groups of turned-on scanning lines are opposite; G1 is an average gray-scale value of a row of pixels corresponding to the last turned-on scanning lines in the previous group, the G2 is an average gray-scale value of a row of pixels corresponding to the first turned-on scanning lines in the current group; the gate driver circuit generates a plurality of first gate drive signals and a plurality of second gate drive signals according to the Δt values obtained by corresponding G1 and G2 in the storage unit, the high-level duration of the first gate drive signals is T+Δt; and the first gate drive signals are output to the first mined-on scanning lines in each group, the second gate drive signals are output to the last turned-on scanning lines in each group.

With respect to an equal-time scanning driving mode, in the present application, the scanning lines are driven to turn on sequentially or non-sequentially in a group of two;

corresponding to the same data line, polarities of the data driving signals of the pixels corresponding to the same group of scanning lines are the same, and polarities of the data driving signals of the pixels corresponding to the two adjacent groups of turned-on scanning lines are opposite; insufficient charge corresponding to first turned-on scanning lines in each group is more obvious due to larger cross-voltage of the data driving signal corresponding to first turned-on scanning lines in each group and smaller cross-voltage of the data driving signal corresponding to last turned-on scanning lines in each group. The time of the first turned-on scanning lines in each group is prolonged, the initial time difference Δt is added to the opening time of the first turned-on scanning lines, therefore, the charging degrees of the two rows of the scanning lines in each group are closer, the bright and dark stripes of the display panel are reduced, and the display effect is improved. The Δt is obtained by an average gray-scale value G1 of a row of pixels corresponding to the last turned-on scanning lines in the previous group and an average gray-scale value G2 of a row of pixels corresponding to the first turned-on scanning lines in the current group, Δt may not be a fixed value, and different values of Δt can be set when a same scanning line corresponds to different gray-scales, so that Δt of the corresponding scanning line can be dynamically adjusted according to different display pictures, and the display effect is better.

BRIEF DESCRIPTION OF DRAWINGS

The accompanying drawings, which are included to provide a further understanding of embodiments of the present application and constitute a part of the specification, illustrate embodiments of the application and, together with the text description, explain the principles of the application. Obviously, the drawings in the following description are merely some embodiments of the present application, and those skilled in the art can obtain other drawings according to the drawings without any inventive labor. In the drawings:

FIG. 3 is a schematic diagram of a compensation table according to an embodiment of the present application;

DETAILED DESCRIPTION OF EMBODIMENTS

It should be understood that the terminology, specific structural and functional details disclosed are merely exemplary for the purpose of describing specific embodiments. However, the present application may be embodied in many alternative forms and should not be construed as being limited to the embodiments set forth herein.

In the description of the present application, the terms "first" and "second" are only for the purpose of description and cannot be construed to indicate relative importance or imply an indication of the number of technical features indicated. Therefore, unless otherwise stated, a feature defined as "first" and "second" may explicitly or implicitly include one or more of the features; "multiple" means two or more. The term "include" and any variations thereof are intended to be inclusive in a non-closed manner, that is, the presence or addition of one or more other features, integers, steps, operations, units, components and/or combinations thereof may be possible.

In addition, the terms "center", "horizontally", "up", "down", "left", "right", "vertical", "horizontal", "top", "bottom", "inner", "outer" and the like for indicating an orientation or positional relationship are based on the description of the orientation or relative positional relationship shown in the accompanying drawings, and are only simplified description facilitating description of the application, and are not intended to indicate that the device or element referred to must have a particular orientation, be configured and operated in a particular orientation, and therefore cannot be construed as limiting the present application.

In addition, unless expressly specified and defined otherwise, the terms "mount", "attach" and "connect" are to be understood broadly, for example, it can be a fixed connection, a detachable connection, or an integral connection; it can be an either mechanical connection or an electrical connection; it can be a direct connection or an indirect connection through an intermediate medium, or an internal connection between two elements. For those skilled in the art, the specific meaning of the above terms in this application can be understood according to the specific circumstances.

The present application will now be described in details by reference to the accompanying drawings and optional embodiments.

The application field of the display panel is gradually expanding ranging displays such as an audio-visual products and laptop computers to desktop computers, monitors for Engineering Work Stations (EWSs) and the like. The driving of liquid crystal display is to establish a driving electric field by adjusting the phase, peak value, frequency and the like of a potential signal applied to the electrode of liquid crystal device, so as to realize the display effect of the display device.

Figure 1:
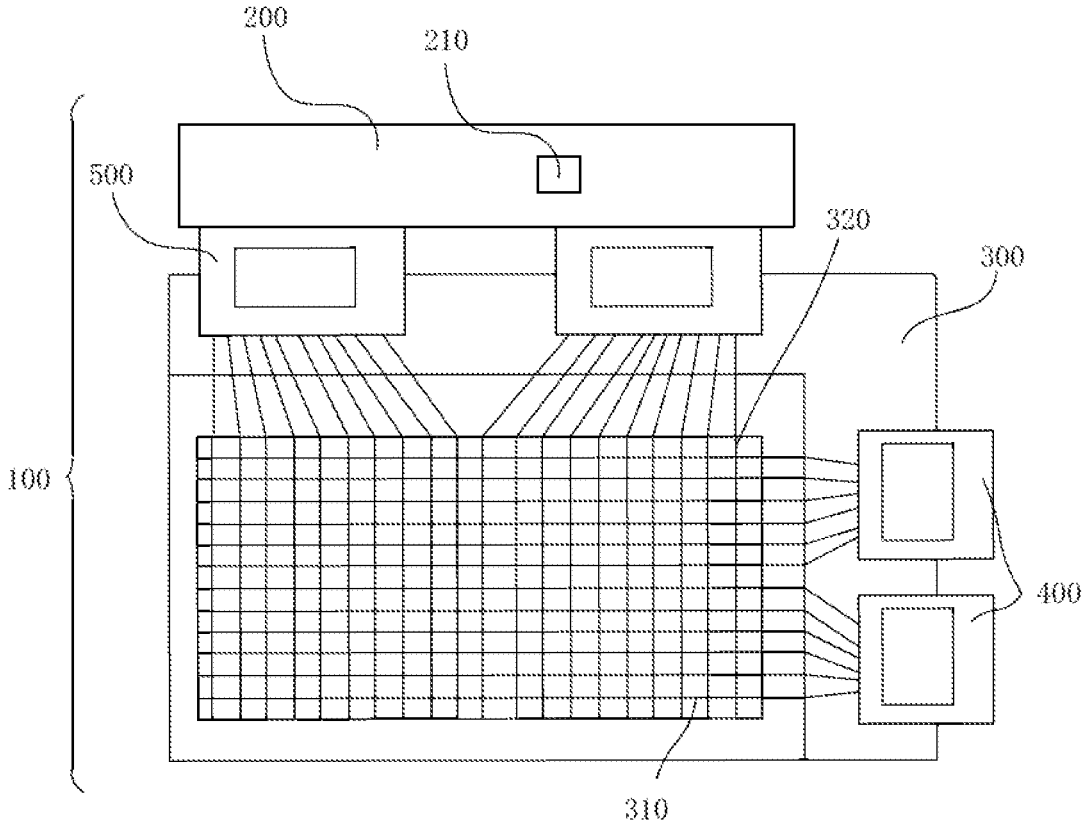
FIG. 1 is a schematic diagram of a display device according to an embodiment of the present application.

As shown in FIG. 1, the present application discloses a display device 100 including a display panel 300, a gate driver circuit 400 and a source driver circuit 500. The gate driver circuit 400 outputs gate drive signals, and the source driver circuit 500 outputs data driving signals to drive the display panel 300.

In a same frame of picture, the gate driver circuit 400 outputs the gate drive signals corresponding to each scanning line 310 one to one, and drives the scanning lines 310 to turn on sequentially or non-sequentially in a group of two;

corresponding to a same data line 320, polarities of the data driving signals of the pixels corresponding to a same group of scanning lines 310 are the same, and polarities of the data driving signals of the pixels corresponding to two adjacent groups of turned-on scanning lines 310 are opposite.

The display device 100 further includes a storage unit 210 and a timing controller 200, and the timing controller 200 is connected to the display panel 300 to transmit data driving signals to the display panel 300. A first gray-scale value G1 is an average gray-scale value of a row of pixels corresponding to the last turned-on scanning lines 310 in the previous group, and a second gray-scale value G2 is an average gray-scale value of a row of pixels corresponding to the first turned-on scanning lines 310 in the current group. The storage unit 210 is located in the timing controller 200, and the storage unit 210 stores a preset compensation table and information of Δt corresponding to the first gray-scale value G1 and the second gray-scale value G2.

Figure 2:
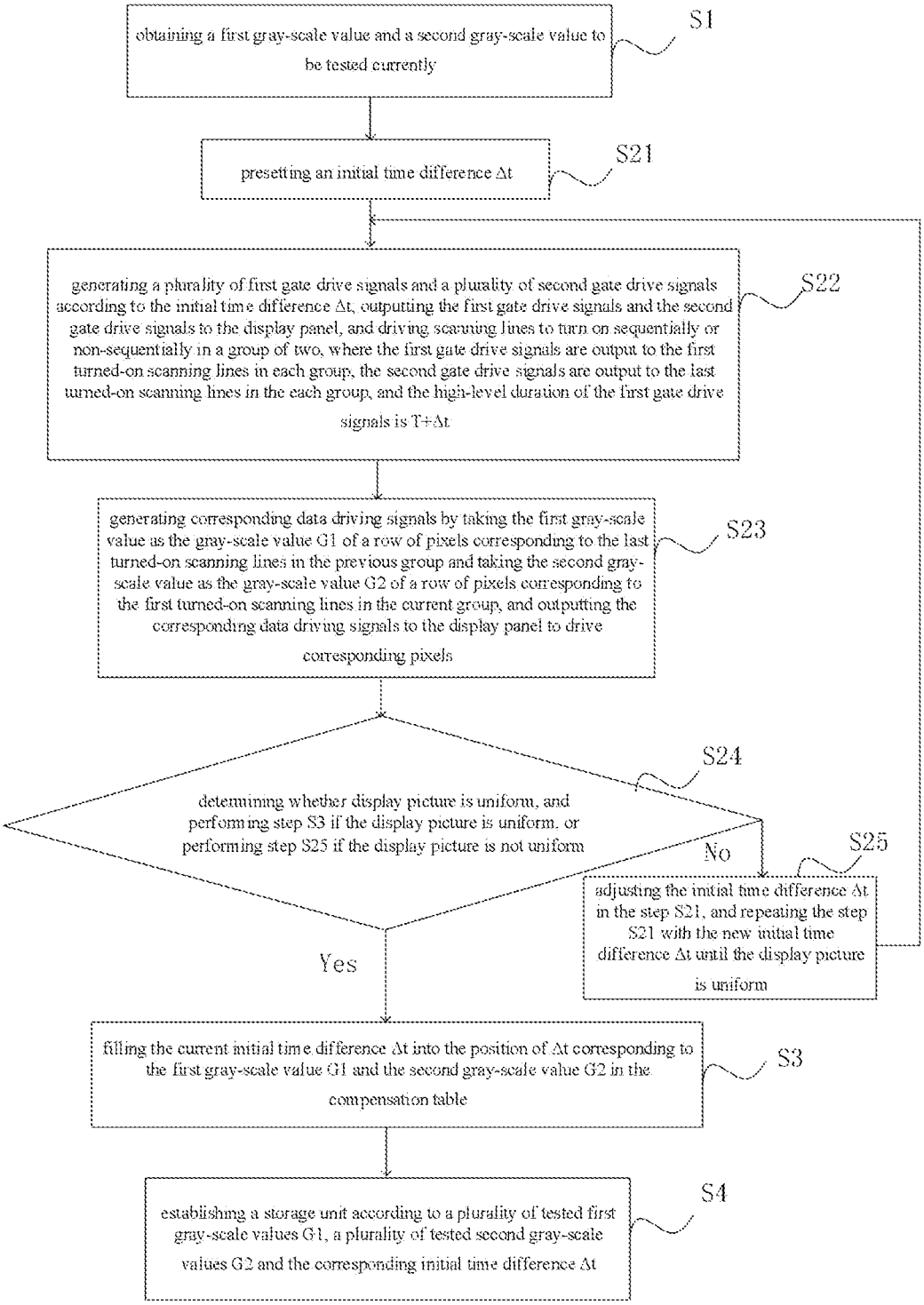
FIG. 2 is a flow schematic diagram of a construction method for a compensation table of a display panel according to an embodiment of the present application.

A preset compensation table stored in the storage unit 210 is constructed and formed in a test stage, and a flowchart of the specific construction method is shown in FIG. 2 and includes steps of:

S1: obtaining a first gray-scale value G1 and a second gray-scale value G2 to be tested currently;

S21: presetting an initial time difference Δt;

S22: generating a plurality of first gate drive signals and a plurality of second gate drive signals according to the initial time difference Δt, outputting the first gate drive signals and the second gate drive signals to the display panel, and driving scanning lines to turn on sequentially or non-sequentially in a group of two, where the first gate drive signals are output to the first turned-on scanning lines in each group, the second gate drive signals are output to the last turned-on scanning lines in the each group, and the high-level duration of the first gate drive signals is T+Δt;

S23: generating corresponding data driving signals by taking the first gray-scale value as the gray-scale value G1 of a row of pixels corresponding to the last turned-on scanning lines in the previous group and taking the second gray-scale value as the gray-scale value G2 of a row of pixels corresponding to the first turned-on scanning lines in the current group, and outputting the corresponding data driving signals to the display panel to drive corresponding pixels;

S24: determining whether display picture is uniform, and performing step S3 if the display picture is uniform, or performing step S25 if the display picture is not uniform;

S25: adjusting the initial time difference Δt in the step S21, and repeating the step S21 with the new initial time difference Δt until the display picture is uniform;

S3: filling the current initial time difference Δt into the position of Δt corresponding to the first gray-scale value G1 and the second gray-scale value G2 in the compensation table; and S4: establishing a storage unit according to a plurality of tested first gray-scale values G1, a plurality of tested second gay-scale values G2 and the corresponding initial time difference Δt.

The first gray-scale value G1 and the second gray-scale value G2 to be tested currently are obtained, the initial time difference Δt is preset in advance, a plurality of first gate drive signals and a plurality of second gate drive signals are generated by a gate driver circuit according to the initial time difference Δt; and whether the picture of a display panel is uniform is determined, if the display picture is not uniform, the preset initial time difference Δt is not suitable, a new different initial time difference Δt is preset until the display picture is uniform, and the preset initial time difference Δt is recorded when the display is uniform, if the display picture is uniform, the preset initial time difference Δt is suitable, the preset initial time difference Δt when the display is uniform is recorded. The initial time difference Δt corresponds to the first gray-scale value G1 and the second gray-scale value G2, the tested data are recorded on the compensation table, then a next different first gray-scale value G1, a second gray-scale value G2 and the corresponding initial time difference Δt are tested, a plurality of groups of data are recorded on the compensation table, and the compensation table is stored in a storage unit for looking up the table when needed. The gray-scale values G1 or G2 are adjusted as initial time differences Δt corresponding to a plurality of gray-scales are required, the next initial time difference Δt is preset until the display picture is uniform, the times of adjusting gray-scale values are determined as required, where the gray-scale values are between −255 and 255 the testing times of when the accuracy requirements on the gray-scale values and the corresponding Δt are not very high is about 2500, and G1 and G2 are not adjusted until Δt is equal to 0.

The initial time difference Δt corresponding to the current first gray-scale value G1 and the current second gray-scale value G2 can be obtained by adjusting the preset Δt for multiple times until the display picture is uniform. Specifically, a schematic diagram of the correspondingly generated compensation table is shown in FIG. 3, where the x-coordinate is the gray-scale value G1 of a row of pixels corresponding to the last turned-on scanning lines in the preset previous group, and the y-ordinate is the gray-scale value G2 of a row of pixels corresponding to the first turned-on scanning lines in the current group. The table states that corresponding G1 and G2 result in Δt of the corresponding scanning line.

Figure 4:
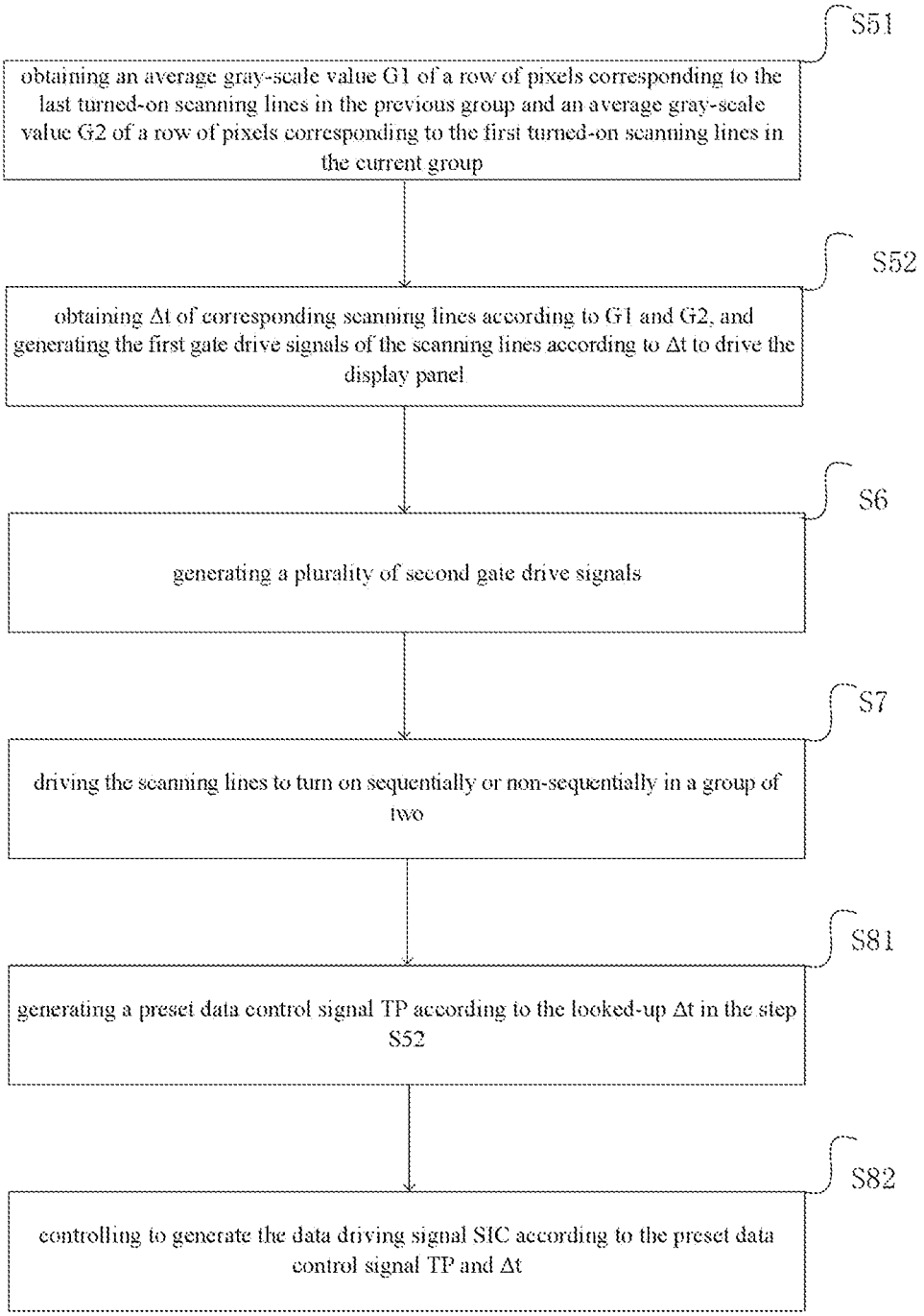
FIG. 4 is a schematic diagram of a method for generating data drive signals according to an embodiment of the present application.

As shown in FIG. 4, the present application also discloses a driving method for a display panel, including steps of:

generating a plurality of first gate drive signals and a plurality of second gate drive signals, driving scanning lines to turn on sequentially or non-sequentially in a group of two; and generating corresponding data driving signals to drive corresponding pixels; corresponding to a same data line, polarities of the data driving signals of the pixels corresponding to a same group of scanning lines are the same, and polarities of the data driving signals of the pixels corresponding to two adjacent groups of turned-on scanning lines are opposite;

where the first gate drive signals are output to the first turned-on scanning lines in each group, the second gate drive signals are output to the last turned-on scanning lines in each group, and the high-level duration of the first gate drive signals is T+Δt;

the step of generating a plurality of first gate drive signals includes steps of:

S51: obtaining an average gray-scale value G1 of a row of pixels corresponding to the last turned-on scanning lines in the previous group and an average gray-scale value G2 of a row of pixels corresponding to the first turned-on scanning lines in the current group;

S52: obtaining Δt of corresponding scanning lines according to G1 and G2, and generating the first gate drive signals of the scanning lines according to Δt to drive the display panel;

S6: generating a plurality of second gate drive signals;

S7: driving the scanning lines to turn on sequentially or non-sequentially in a group of two;

S81: generating a preset data control signal TP according to the looked-up Δt in the step S52; and S82: controlling to generate the data driving signal SIC according to the preset data control signal TP and Δt.

Figures 5, 6:
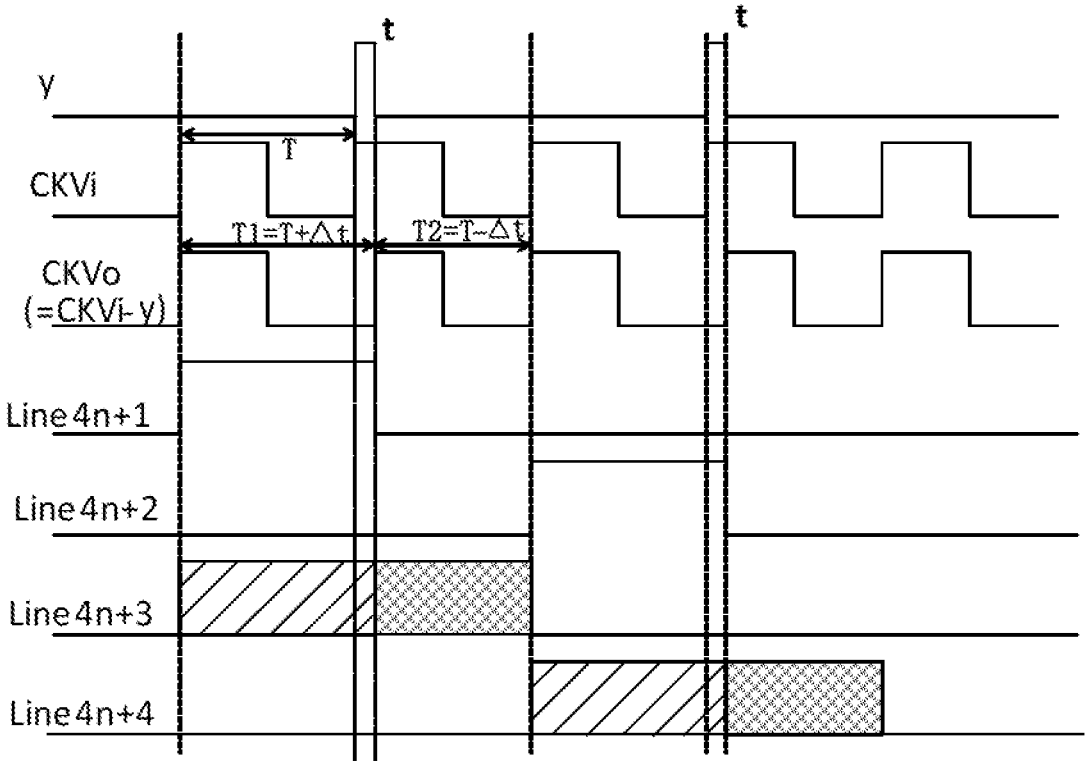
FIG. 5 is a schematic diagram of driving architecture polarity according to an embodiment of the present application.
FIG. 6 is a timing schematic diagram when a gate driver circuit is pre-charged according to an embodiment of the present application.

It should be noted that the first gate drive signals and the second gate drive signals are generated by the gate driver chip and synchronously output to each scanning, line, and the steps are in no particular order. As shown in FIG. 5 taking the display panel in dot inversion mode as an example, the polarities of the data driving signals corresponding to each two rows of the scanning lines on the display panel are opposite, and the cross-voltage is larger, leading larger power consumption of the display panel. According to the solution, two scanning lines are arranged in a group of two, and polarities of the data driving signals of the pixels corresponding to a same group of scanning lines are the same, and polarities of the data driving signals of the pixels corresponding to two adjacent groups of turned-on scanning lines are opposite; specifically, if the four adjacent scanning lines are taken as an example the 4n+1th and 4n+3th rows of the gate drive signals are taken as a group, the 4n+2th and 4n+4th rows of the gate drive signals are taken as a group, the 4n+1th and 4n+2th rows of the gate drive signals are the first gate drive signals, and the 4n+3th and 4n+4th rows of the gate drive signals are the second gate drive signals.

In the present application, the initial time difference Δt is added to the first gate drive signals, i.e., the 4n+1th and 4n+2th rows of the gate drive signals, and the initial time difference Δt is subtracted from the second gate drive signals, i.e., the 4n+3th and 4n+4th rows of the gate drive signals. The high-level duration of the first gate drive signals is T+Δt, because the first gate drive signals charge the first turned-on scanning lines in all groups, the high-level duration of the first gate drive signals needs to be prolonged to ensure that the data driving signals are available for charging when the cross-voltage is high, the second gate drive signals charge all last turned-on scanning lines, and the polarity of the pixel electrode corresponding to the last turned-on scanning lines is the same as that of the pixel electrode corresponding to the first turned-on scanning lines, so that the across-voltage of the data driving signals corresponding, to the last turned-on scanning line is small, ensuring fast charging efficiency, and the high-level duration of the second gate drive signals does not need to add Δt, so that the charging degree of the two rows of seaming lines in each group is closer, the bright and dark stripes of the display panel are reduced, improving the display effect.

The Δt is determined according to the average gray-scale value G1 of a row of pixels corresponding to the last turned-on scanning lines in the previous group and the average gray-scale value G2 of a row of pixels corresponding to the first turned-on scanning lines in the current group, Δt may not be a fixed value, and different values of Δt can be set when a same scanning line corresponds to different gray-scales, so that Δt of the corresponding scanning lines can be dynamically adjusted according to different display pictures, and the display effect is better.

The Δt can be quickly obtained by looking up the table. With reference to FIG. 3, the average gray-scale value G1 of a row of pixels corresponding to the last turned-on scanning line in the previous group of the current frame and the average gray-scale value G2 of a row of pixels corresponding to the first turned-on scanning lines in the current group are obtained, and the Δt of the corresponding scanning lines is obtained by searching a preset compensation table with the obtained G1 and G2 as parameters. The Δt of corresponding scanning lines is obtained according to G1 and G2, and the first gate drive signals of the scanning lines are generated according to Δt to drive the display panel.

As shown in FIG. 6, the high-level duration of the second gate drive signals may be 2T, the high-level duration of the second gate drive signals includes pre-charging time and charging time, where the pre-charging time is T+Δt, and the charging time is T−Δt. The second gate drive signals correspond to the last turned-on scanning lines in a same group, the polarity of the last turned-on scanning lines is the same as that of the first turned-on scanning lines in a same group, therefore, the last turned-on scanning lines can be turned on simultaneously with the first turned-on scanning lines to be pre-charged, so as to improve charging efficiency. The 4n+3th and 4n+4th rows of last turned-on scanning lines are pre-charged simultaneously under the action of the second clock signal y, the scanning and charging the 4n+1th and 4n+2th rows of first turned-on scanning lines is finished when the rising edge of the next period of the first clock signal CKVi is started, and then the 4n+3th and 4n+4th rows of the last turned-on scanning lines is further scanned and charged under the action of the second clock signal y based on the above mentioned pre-charging until the rising edge of the next period of the second clock signal y is started, so that scanning and pre-charging each row of scanning line is finished through the driving mode. The gate drive signals and the data driving signals are matched with each other to drive the corresponding pixels. The corresponding scanning lines are turned-on when the gate drive signals are at a high level. When a pixel is driven, it is required that the gate drive signals are at a high level and the data driving signals output corresponding gray-scale values to the pixel, where the scanning lines corresponding to the gate drive signals may be turned on in advance to pre-charge the current pixel, and the gray-scale values output by the data driving signals driving other rows of pixels may be the gray-scale values of the pixels in other rows. Therefore, even though the high-level duration of the second gate drive signals may be 2T with respect to a same panel, the average time for which the data driving signal drives each pixel is still T.

Figure 7:
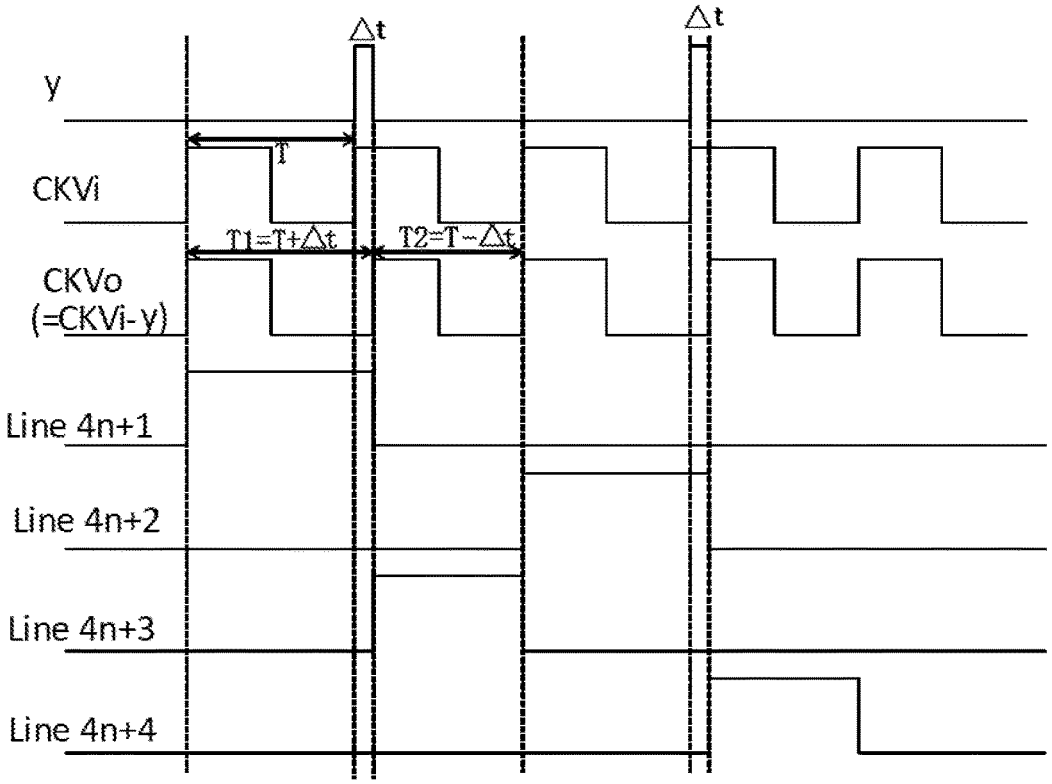
FIG. 7 is a timing schematic diagram when a gate driver circuit is not pre-charged according to an embodiment of the present application.

As shown in FIG. 7, the last turned-on scanning lines in a same group may not be turned on in advance and performed, and the high-level duration of the second gate drive signals is T−Δt. The Δt is the same as a parameter Δt of the first gate drive signals in a same group. That is, in S6 of generating a plurality of second gate drive signals, the second gate drive signals for generating the scanning lines are calculated based on the Δt.

Figure 8:
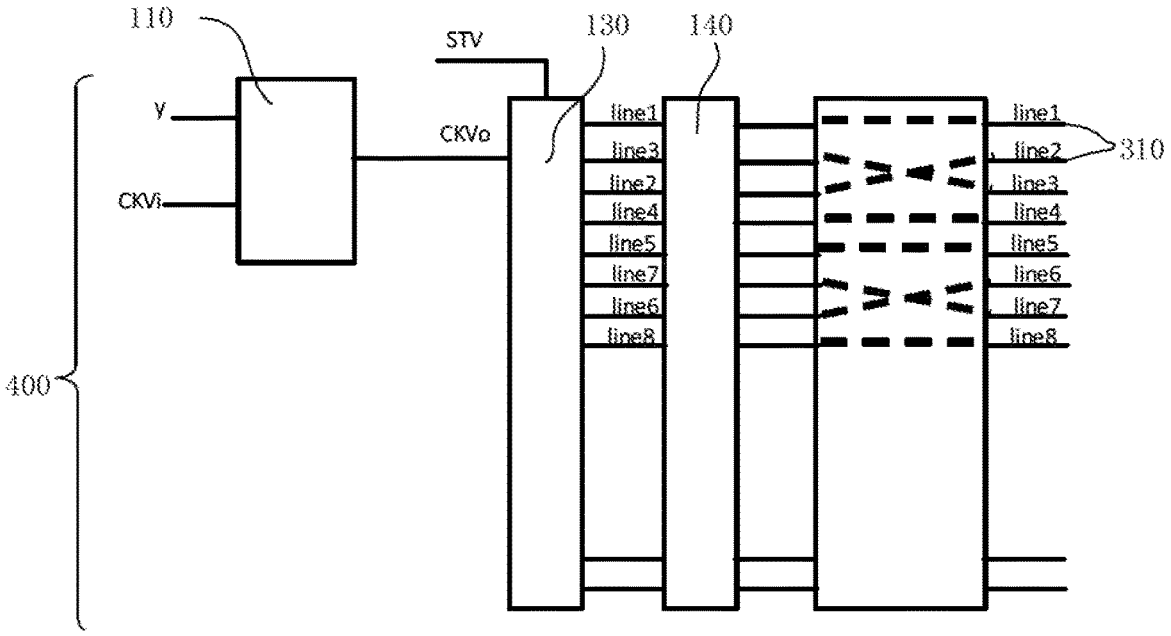
FIG. 8 is a schematic diagram of a gate driver circuit according to an embodiment of the present application.

Corresponding implementation circuit as shown in FIG. 8, the gate driver circuit 400 includes a compensation signal generator 110 for outputting a compensation signal CKVo, a shift trigger 130 for receiving the compensation signal CKVo, and an output buffer 140 for outputting the gate drive signals to each scanning line 310. The compensation signal CKVo is a square-wave signal with 2T as one period; and a first level lasts for T/2, a first second level lasts for T/2+Δt, second first level lasts for T/2−Δt and the second level lasts for a time T/2 in one period. The shift trigger 130 generates a plurality of first gate drive signals and a plurality of second gate drive signals, respectively, the high-level duration of the first gate drive signals is T+Δt, and the plurality of scanning lines 310 are driven to turn on non-sequentially in a group of two. The first gate drive signals are output to the first to med-on scanning lines 310 in each group, the second gate drive signals are output to the last turned-on scanning lines in each group 310, and the first level is high and the second level is low.

The shift trigger 130 receives the first clock signal CKVi and the second clock signal y to generate a plurality of first gate drive signals and a plurality of second gate drive signals, the high-level duration of the first gate drive signal is T+Δt, and the high level duration of the second gate drive signal is T−Δt; during charging, regardless of a sequential or non-sequential mode, the first gate drive signals delay for Δt, and the second gate drive signals reduces for Δt, so as to avoid low charging efficiency in the same time, compensate for charging efficiency between different rows with different polarities, avoid insufficient charging time or unsaturated charging when switching to the next row with opposite polarity; avoid being prone to stripes due to large cross-voltage, balance charging time between each group of scanning lines 310, thus improving quality of display picture.

Specifically, the compensation signal generator 110 receives a first clock signal CKVi and a second clock signal y, and outputs a compensation signal CKVo, where the first clock signal CKVi is a square-wave signal with T as one period, a high level lasts for T/2 and a low level lasts for T/2 in one period, the second clock signal CKVo is a square-wave signal with 2T as one period, and after the first low level lasts for T, the high level lasts for Δt and the second low level lasts for T−Δt in one period. The compensation signal CKVo is output by the compensation signal generator 110 through the first clock signal CKVi and the second clock signal y, and the method that the compensation signal CKVo can be generated only by the superposition of the second clock signal y and the first clock signal CKVi is simpler. The first level may be low and the second level may be high level.

Figures 9, 10:
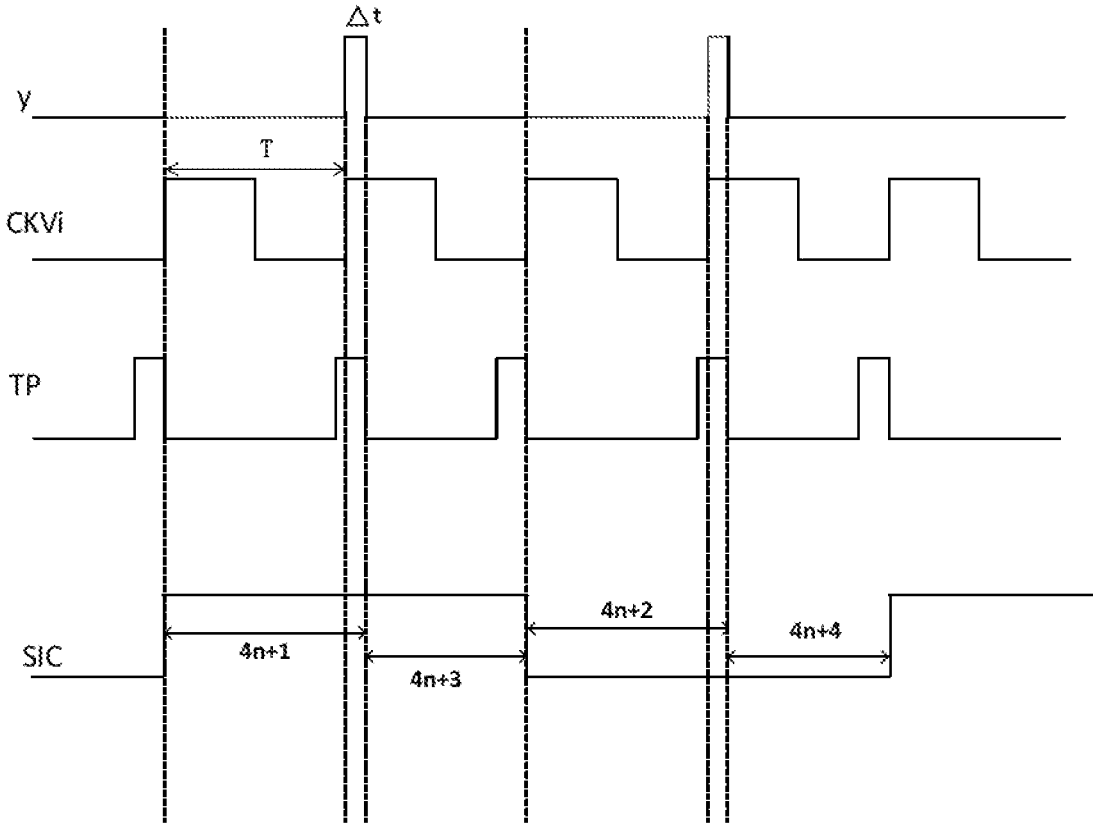
FIG. 9 is a schematic diagram of a source driver circuit according to an embodiment of the present application.
FIG. 10 is a schematic diagram of the polarity of driving architecture in sequential mode according to another embodiment of the present application.

As shown in FIG. 9, in the driving method for the display panel, it is further required to generate the corresponding data driving signal SIC according to the Δt, such that the data driving signal corresponds to the data voltage duration T+Δt when the first gate drive signals are turned on, and corresponds to the data voltage duration T−Δt when the second gate drive signals are turned on.

The generation of the corresponding data driving signal SIC according to the Δt is realized by a data control signal TP. The data control signal TP is generated according to the Δt, the period of the data control signal TP is 2T, the first falling edge of the data control signal TP corresponds to the time when the first gate drive signals are turned on in one period, the time between the first falling edge and the second filling edge of the data control signal TP is T+Δt, and the time between the second falling edge of the data control signal TP and the first falling edge of the next period is T−Δt. The falling edge of the data control signal triggers the data voltage of the data driving signal to switch to the corresponding data voltage when the next gate drive signal is turned on, and the data driving signal SIC corresponds to the data voltage duration T+Δt when the first gate drive signals are turned on, and corresponds to the data voltage duration T−Δt when the second gate drive signals are turned on. Specifically, for the gate drive signal scanned in a non-sequential mode, the charging time of the data driving signal SIC corresponding to the 4n+1th row of scanning line is T+Δt, the charging time of the data driving signal SIC corresponding to the 4n+3th row of scanning line is T−Δt, the charging time of the data driving signal SIC corresponding to the 4n+2th row of scanning line is T+Δt, and the charging time of the data driving signal SIC corresponding to the 4n+4th row of scanning line is T−Δt.

Each falling edge of the data control signal TP corresponds to a rising edge of the compensation signal CKVo obtained by computing the second clock signal y and the first clock signal CKVi so that when the compensation signal scans each row of scanning line, the data driving signal SIC is synchronized with the continuous charging time of the row of scanning line, so that the stripes in the pixels of the display resulted from unsaturated charging of the corresponding rows due to the fact that the scanning time of the gate driver circuit and the charging time of the data driving circuit are not synchronized is avoided.

The source driver circuit outputs a data driving signal SIC to charge the pixel electrode on the corresponding scanning line when the corresponding scanning line is turned on. The data voltage duration of the data driving signal SIC corresponding to the first gate drive signal is T+Δt, the data voltage duration of the data driving signal SIC corresponding to the second gate drive signal is T−Δt regardless of whether the turn-on time of the data driving signal corresponding to the second gate drive signal is 2T or T−Δt, because the gate drive signal is equivalent to the switching signal for the corresponding scanning line and the data driving signal. SIC is equivalent to the charging signal for the corresponding scanning line, and both data driving signal SIC and gate drive signal are turned on together to charge the scanning line.

Figure 11:
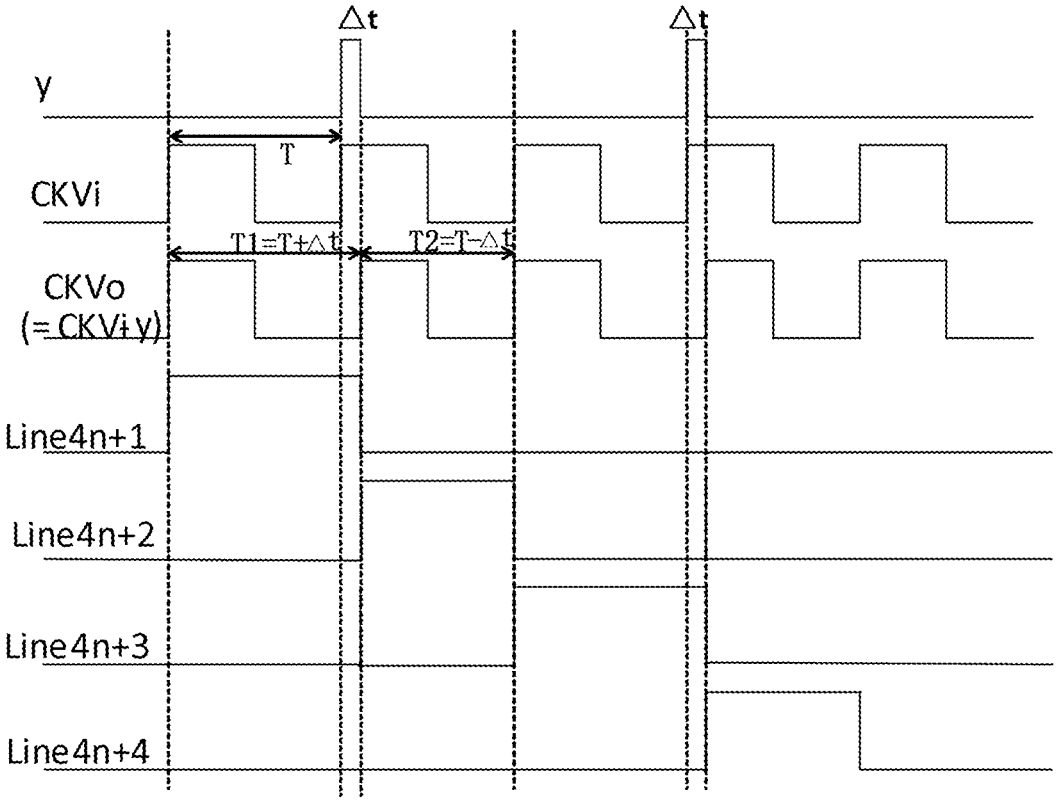
FIG. 11 is a timing diagram of gate driving according to another embodiment of the present application.

As another embodiment of the present application, unlike the above embodiments, in the case that the polarities of two adjacent scanning lines are the same while the polarities of two adjacent groups of scanning lines are opposite, as shown in FIGS. 10 and 11, the gate driving manner of the display panel may be sequentially turned on in a sequential mode, the polarities of all the data driving signals SIC controlled by the scanning lines in each group are the same, and the polarities of all the data driving signals SIC controlled by the scanning lines in the adjacent groups are opposite; for this scanning pattern, the 4n+1th and 4n+2th rows of gate drive signals are a group, and the 4n+3th and 4n+4th rows of gate drive signals are a group, therefore, the 4n+1th and 4n+3th rows of gate drive signals are the first gate drive signals, and the 4n+2th and 4n+4th rows of gate drive signals are the second gate drive signals. The initial time difference Δt is added to the 4n+1th and 4n+3th rows of first gate drive signals, and the initial time difference Δt is subtracted from the 4n+2th and 4n+4th rows of second gate drive signals; the charging time of the data driving signals corresponding to the 4n+1th and the 4n+3th rows of scanning lines is T+Δt, and the charging time of the data driving signals corresponding to the 4n+2th and the 4n+4th rows of scanning lines is T−Δt.

It should be noted that, the limitation of the steps involved in this solution, without affecting the implementation of the specific solution, is not determined to limit the sequence of steps, and the previous steps may be executed first, later, or even simultaneously, and shall be deemed to fall within the scope of the present application as long as the solution can be implemented.

The technical solution of the present application can be applied to a wide variety of display panels, such as Twisted Nematic (TN) display panels, In-Plane Switching (IPS) display panels, Vertical Alignment (VA) display panels, Multi-domain Vertical Alignment (MVA) display panels, and other types of display panels, such as Organic Light Emitting Diode (OLED) display panels.

The above content is a further detailed description of the present application in conjunction with specific, optional embodiments, and it is not to be construed that specific embodiments of the present application are limited to these descriptions. For those of ordinary skill in the art to which this application belongs, a number of simple derivations of substitutions may be made without departing from the spirit of this application, all of which shall be deemed to fall within the scope of this application.

What is claimed is:

1. A driving method for a display panel, comprising steps of:

generating a plurality of first gate drive signals and a plurality of second gate drive signals, driving scanning lines to turn on sequentially or non-sequentially in a group of two; and generating corresponding data driving signals to drive corresponding pixels;

wherein, corresponding to a same data line, polarities of the data driving signals of the pixels corresponding to a same group of scanning lines are the same, and polarities of the data driving signals of the pixels corresponding to two adjacent groups of turned-on scanning lines are opposite;

the first gate drive signals are configured to output to first turned-on scanning lines in each group, the second gate drive signals are configured to output to last turned-on scanning lines in each group, and a high-level duration of the first gate drive signals is T+Δt; and the step of generating a plurality of first gate drive signals comprises steps of:

obtaining an average gray-scale value G1 of a row of pixels corresponding to the last turned-on scanning lines in a previous group and an average gray-scale value G2 of a row of pixels corresponding to the first turned-on scanning lines in a current group; and obtaining Δt of corresponding scanning lines according to G1 and G2, and generating the first gate drive signals of the scanning lines according to Δt to drive a display panel, wherein T is equal to an average time for the data drive signals driving each pixel, and Δt is equal to a time for compensating the first gate drive signals.

2. The driving method for the display panel according to claim 1, wherein the step of generating a plurality of second gate drive signals comprises a step of:

generating the second gate drive signals of the scanning lines according to Δt;

wherein the high-level duration of the second gate drive signals is T−Δt.

3. The driving method for the display panel according to claim 1, wherein in the step of generating a plurality of second gate drive signals:

the high-level duration of the second gate drive signals is 2T.

4. The driving method for the display panel according to claim 3, wherein in the step of generating a plurality of second gate drive signals:

the high-level duration of the second gate drive signals comprises pre-charging time and charging time, wherein the pre-charging time is T+Δt, and the charging time is T−Δt.

5. The driving method for the display panel according to claim 1, wherein the step of obtaining Δt of corresponding scanning lines according to G1 and G2 and generating the first gate drive signals of the scanning lines according to Δt to drive a display panel comprises a step of:

obtaining Δt of the corresponding scanning lines by searching a preset compensation table with the obtained G1 and G2 as parameters;

wherein the compensation table comprises at least three parameters of G1, G2 and Δt, wherein G1 is the gray-scale value of a row of pixels corresponding to the last turned-on scanning lines in a preset previous group, G2 is the gray-scale value of a row of pixels corresponding to the first turned-on scanning lines in a preset current group, and Δt is the corresponding time when G1 and G2 are different gray-scale values.

6. The driving method for the display panel according to claim 1, wherein the step of generating corresponding data driving signals to drive corresponding pixels comprises a step of:

generating the data driving signals according to Δt, wherein, corresponding to a same data line, the data driving signals correspond to the data voltage duration T+Δt when the first gate drive signals are turned on, and correspond to the data voltage duration T−Δt when the second gate drive signals are turned on.

7. The driving method for the display panel according to claim 1, wherein the step of generating corresponding data driving signals to drive corresponding pixels comprises a step of:

controlling to generate the data driving signal according to a preset data control signal;

wherein the period of the data control signal is 2T, the first falling edge of the data control signal corresponds to the time when the first gate drive signals are turned on in one period, the time between the first falling edge and the second falling edge of the data control signal is T+Δt, and the time between the second falling edge of the data control signal and the first falling edge of the next period is T−Δt; and the falling edge of the data control signal triggers the data voltage of the data driving signal to switch to the corresponding data voltage when the next gate drive signal is turned on;

wherein the data driving signal corresponds to the data voltage duration T+Δt when the first gate drive signals are turned on, and corresponds to the data voltage duration T−Δt when the second gate drive signals are turned on.

8. A construction method for a compensation table of a display panel, comprising:

obtaining a first gray-scale value and a second gray-scale value to be tested currently;

testing an initial time difference Δt corresponding to the current first gray-scale value and second gray-scale value;

filling the current initial time difference Δt into a position of Δt corresponding to the first gray-scale value and the second gray-scale value in the compensation table; and establishing a storage unit according to a plurality of tested first gray-scale values, a plurality of tested second gray-scale values and a corresponding initial time difference Δt, wherein the step of testing the initial time difference Δt corresponding to the current first gray-scale value and second gray-scale value comprises steps of:

presetting an initial time difference Δt;

generating a plurality of first gate drive signals and a plurality of second gate drive signals according to the initial time difference Δt, outputting the first gate drive signals and the second gate drive signals to the display panel, and driving scanning lines to turn on sequentially or non-sequentially in a group of two, wherein the first gate drive signals are output to the first turned-on scanning lines in each group, the second gate drive signals are output to the last turned-on scanning lines in the each group, and the high-level duration of the first gate drive signals is T+Δt;

generating corresponding data driving signals by taking the first gray-scale value as the gray-scale value G1 of a row of pixels corresponding to the last turned-on scanning lines in the previous group and taking the second gray-scale value as the gray-scale value G2 of a row of pixels corresponding to the first turned-on scanning lines in the current group, and outputting the corresponding data driving signals to the display panel to drive corresponding pixels;

determining whether a display picture is uniform, and performing step filling the initial time difference Δt into the position of Δt corresponding to the first gray-scale value and the second gray-scale value in the compensation table when the display picture is uniform, or in the case where the displayed image is not uniform, performing adjusting the initial time difference Δt, and repeating the step generating a plurality of first gate drive signals and a plurality of second gate drive signals according to the initial time difference Δt, outputting the first gate drive signals and the second gate drive signals to the display panel, and driving scanning lines to turn on sequentially or non-sequentially in a group of two, wherein the first gate drive signals are output to the first turned-on scanning lines in each group, the second gate drive signals are output to the last turned-on scanning lines in the each group, and the high-level duration of the first gate drive signals is T+Δt with a new initial time difference Δt until the display picture is uniform when the display picture is not uniform.

9. A display device, comprising:

a display panel;

a gate driver circuit outputting a gate drive signal to drive the display panel;

a source driver circuit outputting a plurality data driving signals to drive the display panel; and a storage unit storing a preset compensation table and information of Δt corresponding to G1 and G2;

wherein, in a same frame of picture, the gate driver circuit outputs the gate drive signals corresponding to each scanning line one to one, and drives scanning lines to turn on sequentially or non-sequentially in a group of two; corresponding to a same data line, polarities of the data driving signals of pixels corresponding to a same group of scanning lines are the same, and polarities of the data driving signals of pixels corresponding to two adjacent groups of turned-on scanning lines are opposite;

G1 is an average gray-scale value of a row of pixels corresponding to the last turned-on scanning lines in a previous group, and G2 is an average gray-scale value of a row of pixels corresponding to the first turned-on scanning lines in a current group;

the gate driver circuit generates a plurality of first gate drive signals and a plurality of second gate drive signals according to the Δt obtained by corresponding G1 and G2 in the storage unit, and a high-level duration of the first gate drive signals is T+Δt; and the first gate drive signals are output to the first turned-on scanning lines in each group, and the second gate drive signals are output to the last turned-on scanning lines in each group, wherein T is equal to an average time for the data drive signals driving each pixel, and Δt is equal to a time for compensating the first gate drive signals.

10. The display device according to claim 9, wherein the display device comprises a timing controller, and the storage unit is located in the timing controller.

11. The display device according to claim 9, wherein the gate driver circuit comprises a compensation signal generator for outputting a compensation signal, wherein an input terminal of the compensation signal generator is connected to a first clock signal and a second clock signal, a shift trigger for receiving the compensation signal, and an output buffer connected to an output terminal of the shift trigger for outputting the gate drive signal to each scanning line;

wherein the first clock signal is a square-wave signal with T as one period, a high level lasts for T/2 and a low level lasts for T/2 in one period, the second clock signal is a square-wave signal with 2T as one period, and after the first low level lasts for T, the high level lasts for Δt and the second low level lasts for T−Δtin one period.

12. The display device according to claim 11, wherein the control terminal of the shift trigger is connected with a frame start time signal, and the frame start time signal outputs a trigger signal to start the shift trigger before each frame of picture is displayed.

13. The display device according to claim 11, wherein, the high-level duration of the second gate drive signals comprises pre-charging time and charging time, wherein the pre-charging time is T+Δt, and the charging time is T−Δt.

14. The display device according to claim 11, wherein the high-level duration of the second gate drive signals is T−Δt.

15. The display device according to claim 9, wherein, corresponding to a same data line, the data driving signals correspond to the data voltage duration T+Δt when the first gate drive signals are turned on, and correspond to the data voltage duration T−Δt when the second gate drive signals are turned on.

16. The display device according to claim 15, wherein, corresponding to a same data line, the data driving signal is generated according to a preset data control signal, wherein the period of the data control signal is 2T, the first falling edge of the data control signal corresponds to the time when the first gate drive signals are turned on in one period, the time between the first falling edge and the second falling edge of the data control signal is T+Δt, and the time between the second falling edge of the data control signal and the first falling edge of the next period is T−Δt; and the falling edge of the data control signal triggers the data voltage of the data driving signal to switch to the corresponding data voltage when the next gate drive signal is turned on.

* * * * *